US005093943A

United States Patent [19]

Wei

[11] Patent Number: 5,093,943

[45] Date of Patent: Mar. 10, 1992

[54] MULTI-FUNCTION SHOWER HEAD

[75] Inventor: Yung-Kuan Wei, Tainan, Taiwan

[73] Assignee: Hsiang Kuei Hsien, Tainan, Taiwan

[21] Appl. No.: 533,582

[22] Filed: Jun. 4, 1990

[51] Int. Cl.[5] ..... A47K 3/22; A47K 7/02

[52] U.S. Cl. ..... 4/615; 4/606; 4/567; 239/102.1

[58] Field of Search ..... 4/596, 606, 615, 597, 4/559, 598, 567; 239/102.1, 310; 15/29

[56] References Cited

U.S. PATENT DOCUMENTS

| | | | |
|---|---|---|---|
| 4,224,700 | 9/1980 | Blays | 4/596 |
| 4,303,201 | 12/1981 | Elkins et al. | 4/596 |
| 4,933,999 | 6/1990 | Mikiye et al. | 4/615 |
| 4,998,836 | 3/1991 | Scripnick | 239/310 |

*Primary Examiner*—Henry J. Recla
*Assistant Examiner*—David J. Walczak
*Attorney, Agent, or Firm*—Bacon & Thomas

[57] ABSTRACT

A multi-function shower head comprising a shower head body mounted at the upper end of a grip and several units for making bubbles, message, scrubbing, etc. passible to be selectably and additionally attached on the shower head body. The shower head body is provided with three water passages to be selectably connected with a tubular water passage in the grip for water to run out of many small holes in the outer surface of the shower head body. The grip also has a tubular passage for soap solution and a tubular passage for a wire rope to fit in and rotated by a motor so as to rotate a cylindrical shaft used for combining any of the several extra units for different purposes of bathing.

7 Claims, 11 Drawing Sheets

FIG. 5A
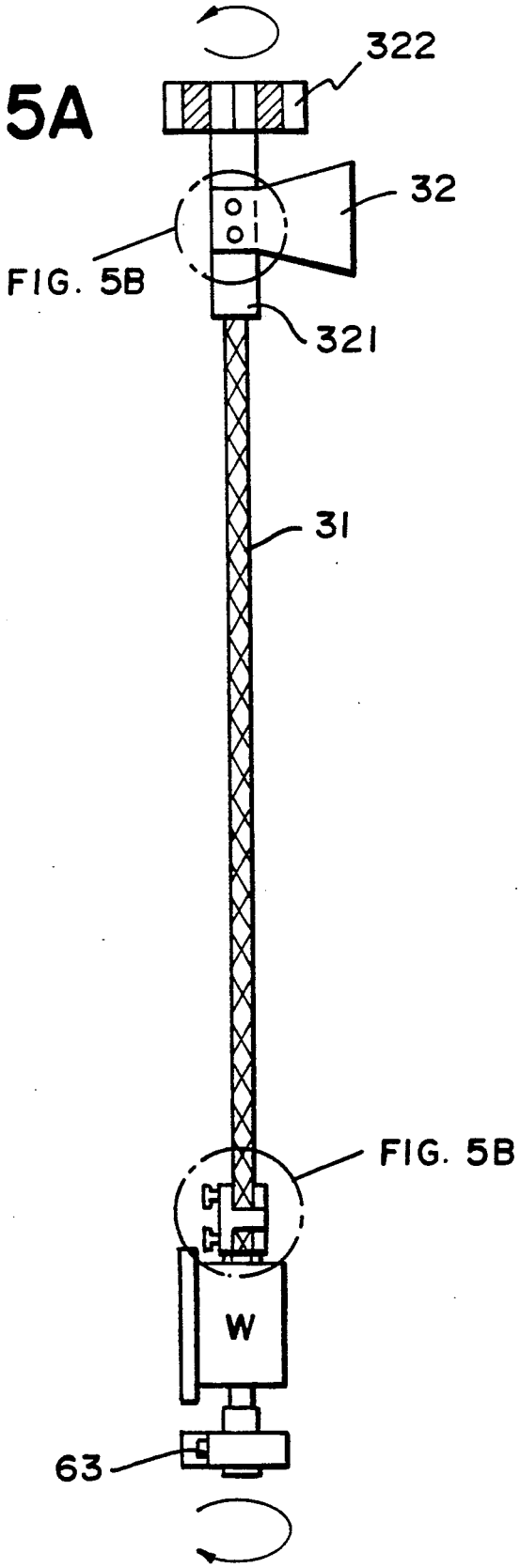
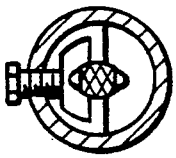
FIG. 5B

MULTI-FUNCTION SHOWER HEAD

BACKGROUND OF THE INVENTION

A shower head functions to let out water through a plurality of small holes on a human body in bathing. Bathing is an indispensable daily routine not only for cleaning a human body but for healing fatigue to recover bodily fittness. Though there are not a few bathing appliances such as sauna, massage bathtubs, they are too costly for common people.

SUMMARY OF THE INVENTION

This invention has aimed to have the following features.

1. It has functions to supply water and soap solution, to give rise to bubbles, to clean, scrub or massage a human body with extra units adapted to be additionally attached on the shower head.

2. It has an extra electric heating case, which provides hot vapor or heated air, stores soap solution and a motor therein to rotate a wire rope.

3. It comprises an electric time circuit for supplying water and an electric time circuit for turning on and off a heater.

The multi-function shower head in the present invention comprises a shower head body and a grip combined together, a bubble unit, a sponge unit, a massage unit and a scrubbing unit to be additionally attached on the shower head body, and an electric heat case.

The shower head body comprises an outlet disc at the top, an upper gate disc at the middle and a lower gate disc at the bottom assembled together. The outlet disc has many water holes arranged along three concentric circles, and the upper and the lower gate disc respectively have three concentric ring grooves corresponding to one another and a long groove formed radially for a cylindrical gate to fit in. The cylindrical gate has three water holes perforated in its wall in unlinear position. The water holes in the outlet disc and the three concentric ring grooves in the upper and the lower gate disc form three water passages and communicate with one of the three holes in the cylindrical gate by turning said gate.

The grip has its top combined with the shower head body, provided with three tubular passages, one for water to run through, another for soap solution to run through, and another for a wire rope to go through. The wire rope has its top end connected with a shaft of a swinging iron block in the upper section of the grip and its bottom end connected with a shaft of a motor such that the wire rope can be rotated by the motor and thus rotates the swinging iron block. The shaft of said iron block is also connected with a pair of gears to rotate a cylindrical shaft which is set passing through the center of the shower head body and a square shaft of any extra unit for bubbling, massaging, etc. can be additionally combined with by inserting said shaft in a square hole in said cylindrical shaft.

The extra electric heating case comprises three chambers one for storing soap solution, another for heating water and another for mounting the motor to rotate the wire rope and a blower.

The soap solution is to be controlled in sending out in one tubular passage in the grip and then to the shower head body by a push button switch installed in the grip.

An electric time circuit is provided to control a water supply supplying water in a heating chamber in the electric heat case for a preset period of time.

In addition, an electric time circuit is provided for turning on and off the heater to heat the water in the heating chamber for a pre-set period of time to produce hot vapor to be sent to the shower head body.

BRIEF DESCRIPTION OF THE DRAWINGS

FIGS. 5*a* and 5*b* show an elevational view of the wire rope and its accessory, respectively, in the present invention.

DETAILED DESCRIPTION OF THE INVENTION

The multi-function shower head 1 in the present invention, as shown in FIGS. 1, 3, 4 and 16, comprises a shower head body 4 and a grip 11 combined together, an extra bubble unit A, an extra sponge unit B, an extra massage unit C, an extra scrubbing unit D and an extra electric heat case 6 as the main components.

Figure 3:
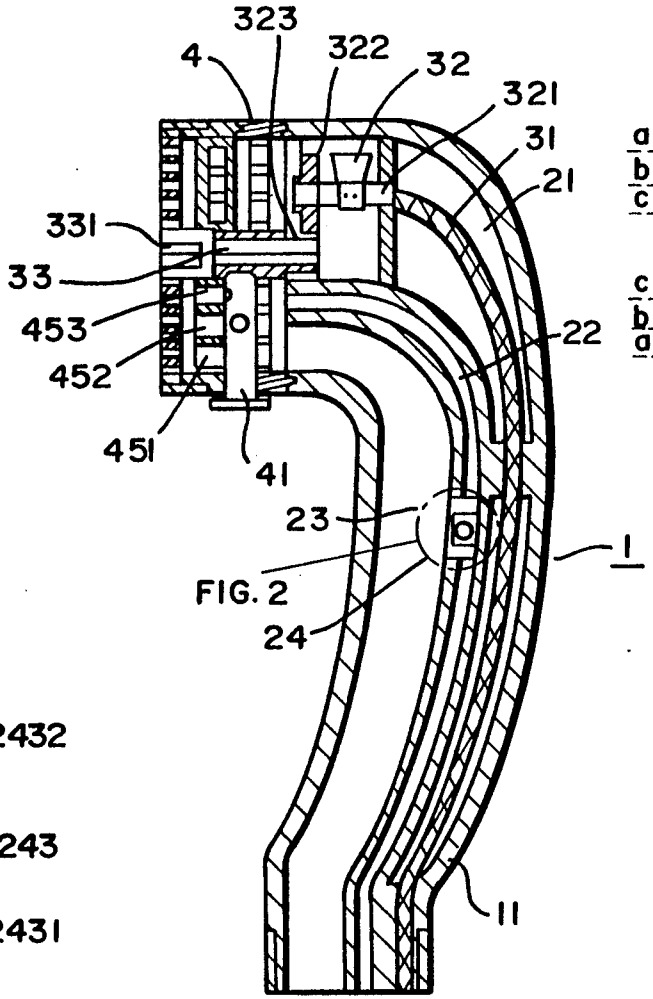
FIG. 3 is an cross-sectional view of the multi-function shower head in the present invention.

The grip 11, as best shown in FIG. 3, has three hollow tubular passages 21, 22 and 23 in its interior. A wire rope 31 is disposed in the passage 21, having its upper end fixed firmly at a shaft 321 of a swinging iron block 32 and its lower end connected with a shaft of a motor M, as shown in FIG. 5. The wire rope 31 can be rotated by the motor M, transmitting rotation to the shaft 321, which in turn rotates a gear 322 and accordingly a gear 323 engaging with the gear 322. As the gear 323 is fixed on a cylindrical shaft 33, on which the extra bubble unit A, or the extra massage unit B, etc. as shown in FIGS. 6–13 can be additionally assembled respectively so as to be rotated by the shaft 33.

Figure 7:
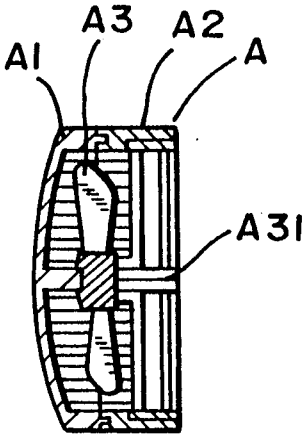
FIG. 7 is a cross-sectional view of the bubble unit in the present invention.
Figure 6:
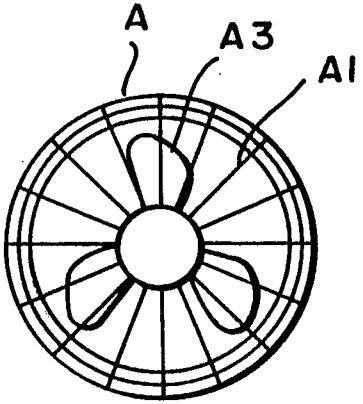
FIG. 6 is a front view of the bubble unit in the present invention.

The extra bubble unit A, as best shown in FIGS. 6 and 7, comprises filter nets A1 and A2 and a fan blade A3 and a square shaft A31 fitting in a square central hole 331 of the shaft 33 so as to be rotated by the motor M. Thus, when the bubble unit A assembled with the shower head 1 is put and rotated in the water in a bathtub, it can give rise to bubbles by striking the water mixed with soap solution or the like.

Figure 9:
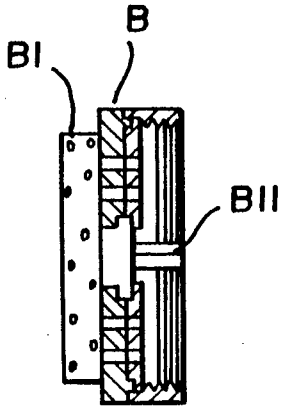
FIG. 9 is a cross-sectional view of the sponge unit in the present invention.
Figure 8:
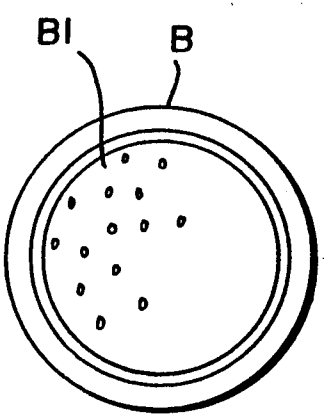
FIG. 8 is a front view of the sponge unit in the present invention.

The extra sponge unit B as shown in FIGS. 8 and 9 comprises a sponge B1 and a square shaft B11 fitting in the hole 331 of the shaft 33 so that the sponge B1 can be rotated and scrub clean a human body with soap solution added on.

Figure 11:
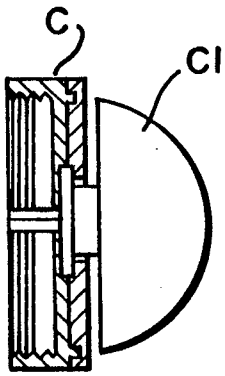
FIG. 11 is a cross-sectional view of the massage unit in the present invention.
Figure 10:
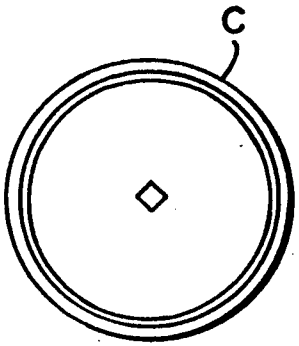
FIG. 10 is a front view of the massage unit in the present invention.

The extra massage unit C shown in FIGS. 10 and 11 comprises a massage semi-circular member C1 and a square shaft to fit in the hole 331 of the shaft 33 so as to be vibrated by the unbalanced movement of the swinging iron block 32 rotated by the wire rope 31.

Figure 13:
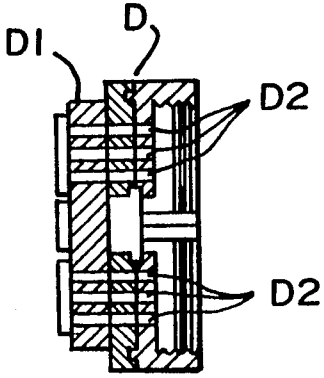
FIG. 13 is a cross-sectional view of the scrubbing unit in the present invention.
Figure 12:
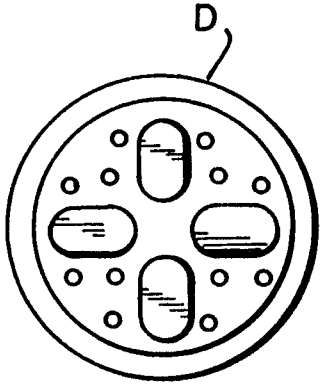
FIG. 12 is a front view of the scrubbing unit in the present invention.

The scrubbing unit D as shown in FIGS. 12 and 13 comprises a sponge or rubber D1 having a rough surface so as to scrub and clean a human body with water coming from passages D2, which are axially formed therethrough, when the scrubbing unit D is assembled with the shower head. Those four kinds of units can be selectably used in bathing.

Figure 2:
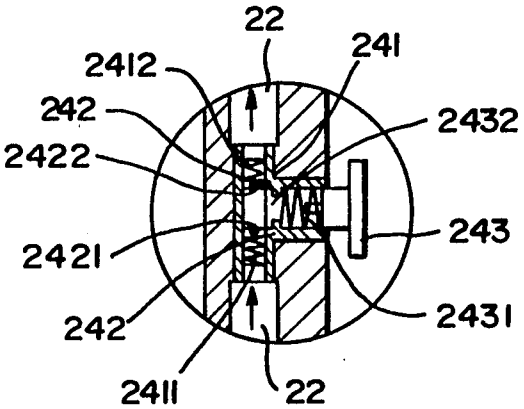
FIG. 2 is a cross-sectional view of the push button switch in the present invention.
Figure 17:
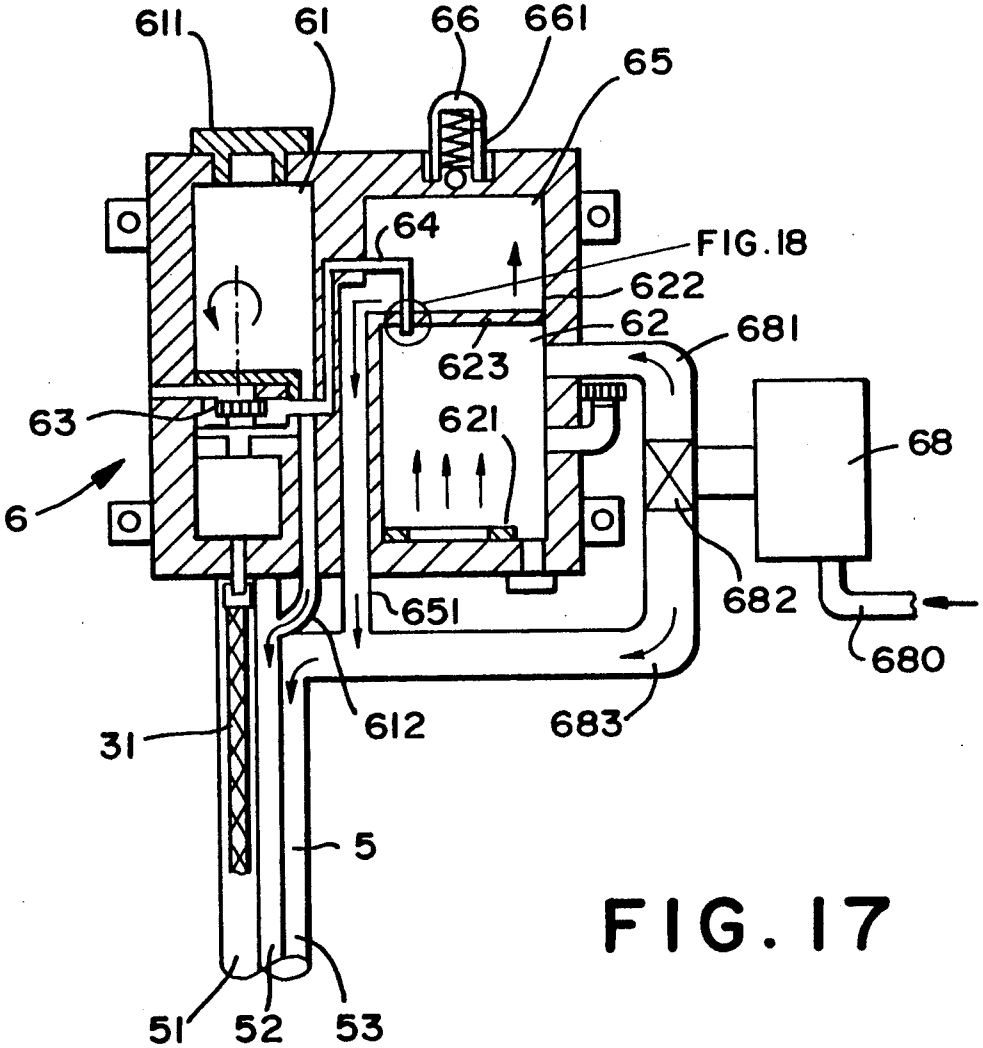
FIG. 17 is a cross-sectional view of the electric head case in the present invention.

The electric heat case 6 as shown in FIG. 17 comprises a storing chamber 61 for keeping soap solution therein. The storing chamber 61 has an outlet 612 and to communicate the tubular passage 22 to supply soap solution to the shower head body 4 by operating the push button switch 24. The push button switch 24 as shown in FIG. 2, comprises two valve openings 241, 242, two balls 2421, and two springs 2411 and 2412 urging said balls in the tubular passage 22, and a push button 243 set sidewise in the wall of the grip 11 and a spring 2431 under the button 243 to push a push block 2432. When the push button 243 is pressed to move the spring 2431 and the push block 2432 in order, the push block 2432 can move the balls 2421, 2422 to leave the valve openings 241 and 242 so that the soap solution can enter the upper section of the tubular passage 22 through the valve opening 241. On the contrary, if the button 243 is released to recover its original position, the valve openings 241 and 242 are automatically blocked by the balls 2412 and 2422 urged by the springs 2411 and 2422.

Figure 1:
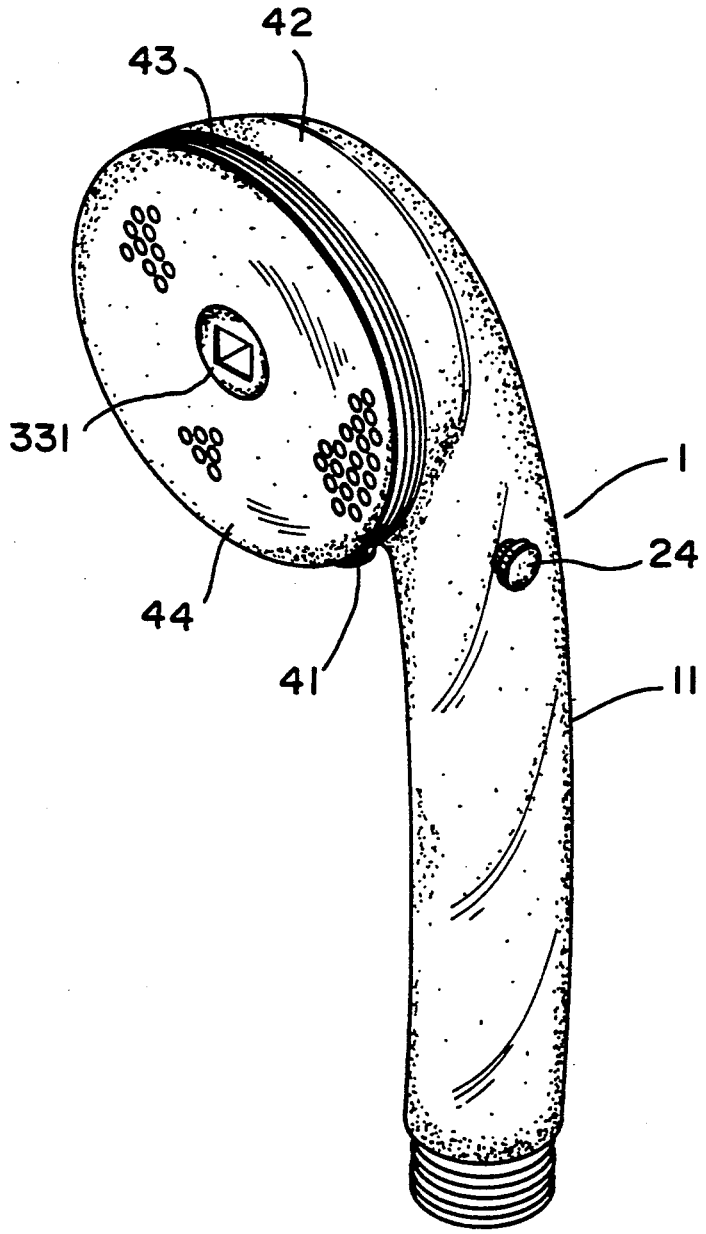
FIG. 1 is a perspective view of the multi-function shower head in the present invention.
Figure 4:
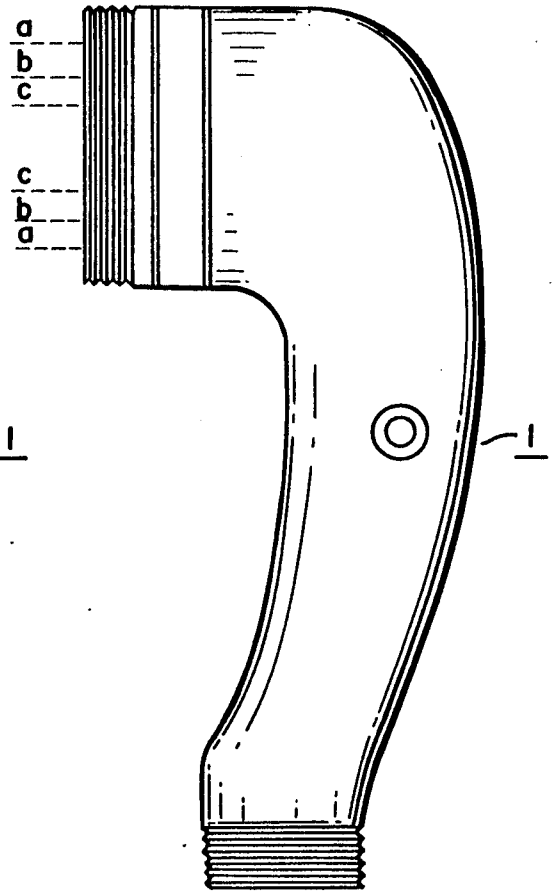
FIG. 4 is a side view of the multi-function shower head in the present invention.
Figure 14:
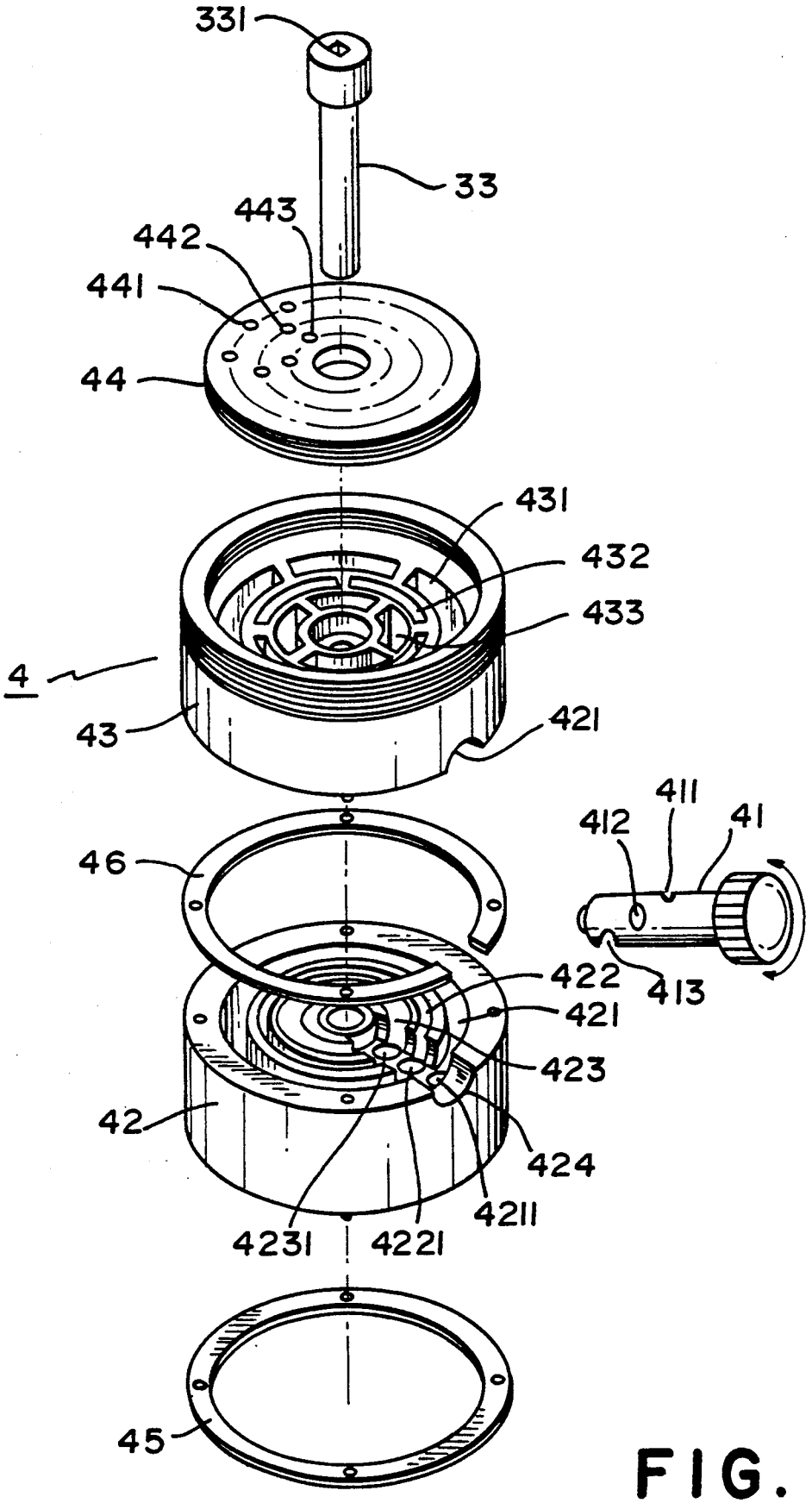
FIG. 14 is an exploded perspective view of the multi-function shower head in the present invention.

A shower head body 4 as shown in FIG. 14 is firmly mounted at the upper end of the grip 11, having a cylindrical gate 41, a lower gate disc 42, an upper gate disc 43, an outlet disc 44, and two anti-leak gaskets 45 and 46 combined together. The cylindrical gate 41 is fitted in a long groove 424 in the lower gate disc 42 and the upper gate disc 43, having three inlet holes 411, 412 and 413 formed irregularly not on a straight line. The lower gate disc 42 is provided with three concentric ring grooves 421, 422 and 423 and the upper gate disc 43 with three concentric ring grooves 431, 432 and 433. The outlet disc 44 is provided with a plurality of holes 441, 442 and 443 located along three concentric circles to correspond to the two groups of three concentric ring grooves 421, 422, 423, 431, 432, and 433, forming three—one of the outer, another of the middle and another of the inner—water passages 451, 452 and 453, as best shown in FIG. 3. After the outlet disc 44, the upper gate disc 43 and the lower gate disc 42 are orderly assembled together with screws, the water coming from the tubular passage 23 can be selected to flow through one of the three inlet holes 411, 412, and 413 in the gate 41, one of three round holes 4211, 4221, and 4231 in the three ring grooves 421, 422 and 423 and then finally through one of the holes 441, 442 and 443 in the outlet disc 44 as sprayed water in one of the three concentric circles a, b and c as shown in FIG. 4. In addition, for preventing the shower head body 4 from leaking, the anti-leak gaskets 45 and 46 are respectively pinched between the lower and the upper gate disc and the grip 11.

Figure 16:
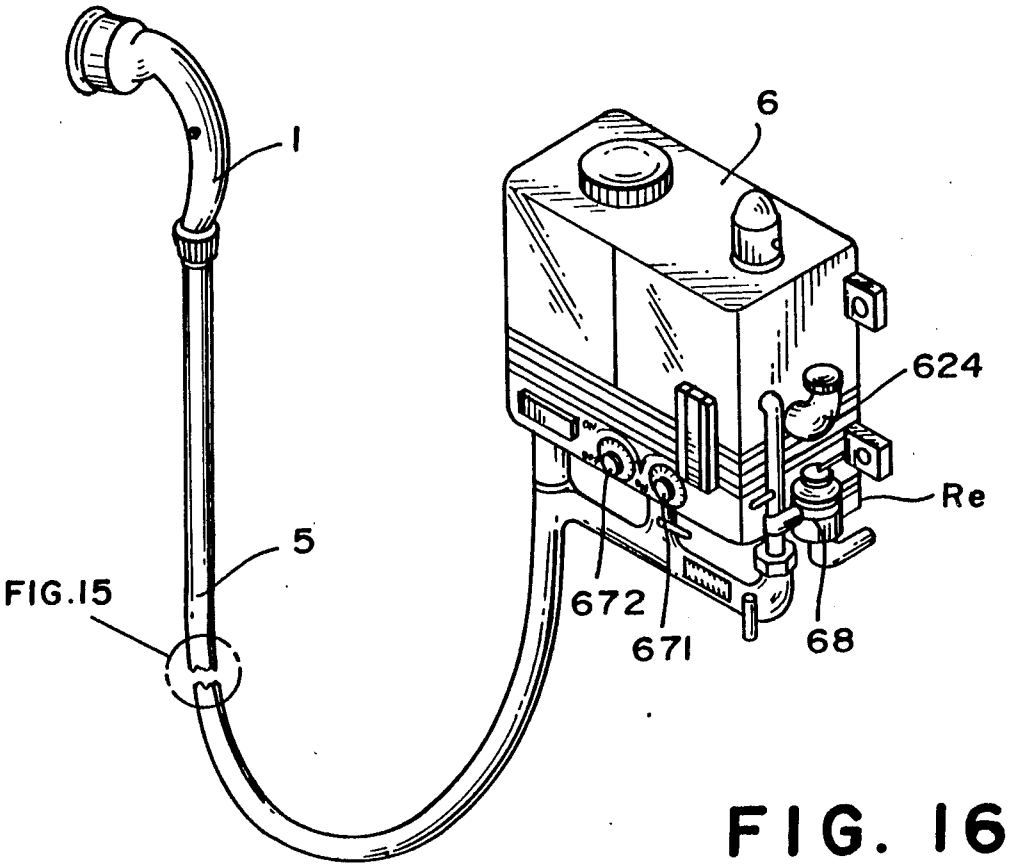
FIG. 16 is a perspective view of the multi-function shower head connected with the electric heat case in the present invention.
Figure 15:
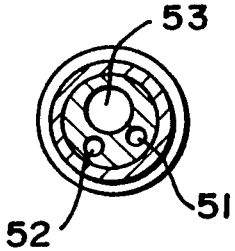
FIG. 15 is a cross-sectional view of the water hose for the multi-function shower head in the present invention.
Figure 18:
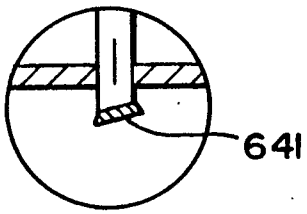
FIG. 18 is a cross-sectional view of the one-way valve for the connecting tube in the present invention.

The shower head 1 can also be connected with a water hose 5 as shown in FIG. 16. The water hose 5, as best shown in FIG. 15, has three water passages 51, 52 and 53 which are respectively led to the hollow tubular passages 21, 22, 23 in the shower head 1. The electric heat case 6 is divided into three chambers. One of said chambers, as shown in FIGS. 16 and 17, is for installing the motor M therein, another is a storing chamber 61 for soap solution and another a heating chamber 62. The storing chamber 61 has a lid 611 for filling in soap solution and an outlet tube 612 connected to communicate the hollow tubular passage 22 the shower head 1 through the water passage 52 in the hose 5. The heating chamber 62 has an electric heater 621 fixed therein for heating and vaporizing the water therein, and the hot vapor produced therein is to be mixed; with air blown therein through a connecting tube 64 by a blower 63 connected with the motor M. Then the vapor mixed with air is to run out of a hole 623 in an upper horizontal wall 622 in an air chamber 65, from which the vapor mixed with air runs out through an outlet tube 651 to a place it is used as sauna vapor. The connecting tube 64 is provided with a one-way valve 641 at its end as shown in FIG. 18 to prevent the vapor from running back in the blower. In addition, a safety valve 66 is mounted at the upper wall of the air chamber 65 to let out an excessively high pressure vapor through a ball 661 therein to prevent explosion caused by too high pressure of the vapor therein. A filling tube 624 is provided at the side wall to fill water in the heating chamber 62.

A water inlet pipe 680 is provided to supply water to the shower head 1 from a suitable water source (not shown). The inlet end of the water inlet pipe 680 is divided into a first branch 681 connected to the electric heat case 6 to feed water into the heating chamber 62 and a second branch 683 by-passing the electric heat case 6 to communicate the water passage 53 in the hose 5. A water control valve assembly 68 is assembled in the inlet end of the pipe 680 with a valve 682 to control the water flow in the pipe 680 either into the first branch 681 or the second branch 683.

The wire rope 31 and the blower 63 are respectively connected with both ends of the shaft of the motor M in such a way that the motor rotates only the wire rope 31 when it rotates clockwise and rotates only the blower 63 when it rotates counterclockwise. This function of two different rotations of the motor M is attained by two needle bearings of one way rotation fixed at each end of the shaft.

Figure 19:
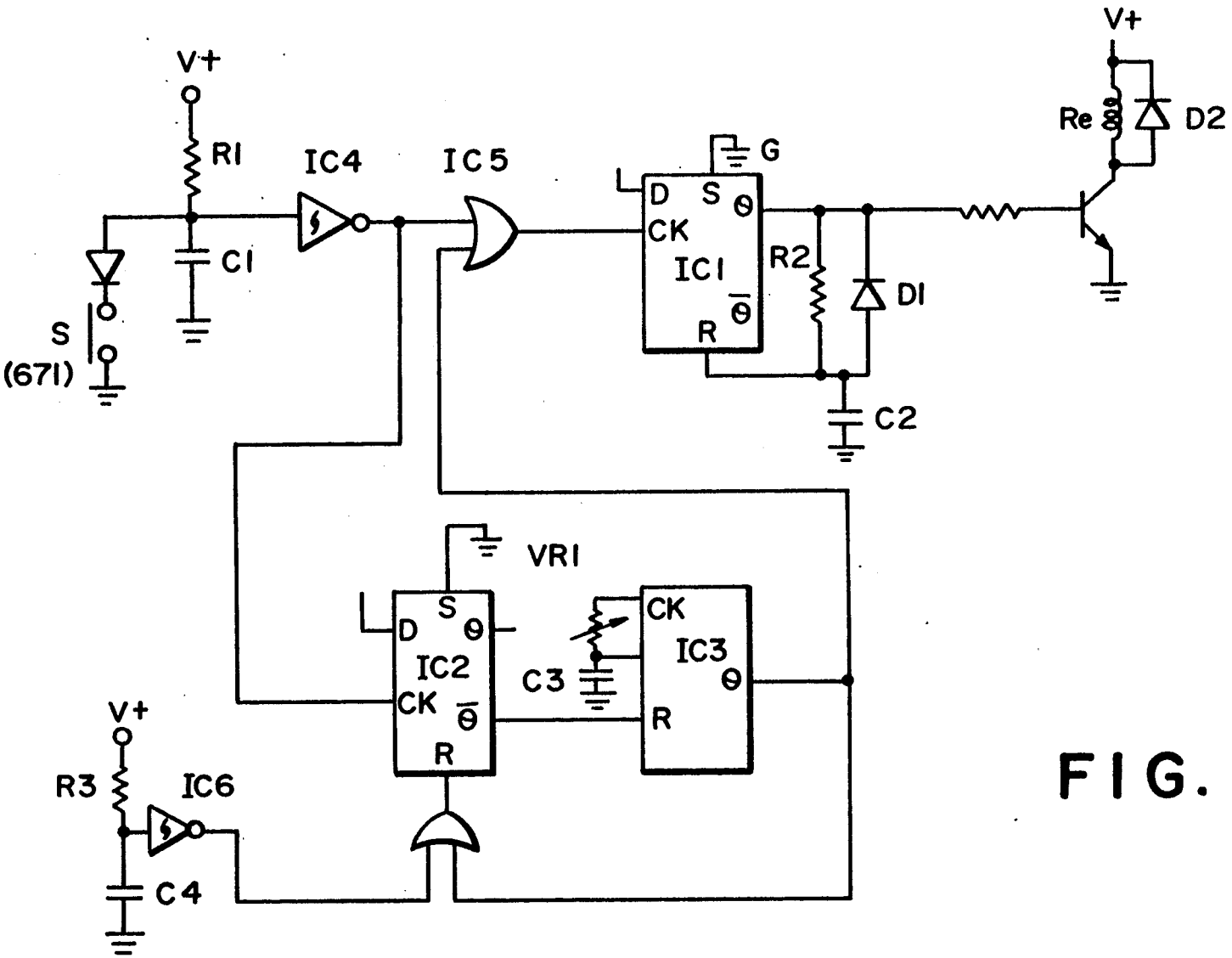
FIG. 19 is the diagram of the electric circuit for controlling water supply to the shower head in the present invention.

A time switch 671 shown in FIG. 16 is provided at the lower section of the electric heat case 6 and marked as S in the diagram of a water supply control electric circuit illustrated in FIG. 19, functioning as an operator of an electro-magnetic valve Re installed at a side wall of the electric heat case 6. When the switch 671 is turned on, a plus signal is sent out of IC1 to actuate the electro-magnetic valve Re, which is then energized to begin to supply water to the shower head. In addition, the supplying time is also counted by IC1, and when the preset time ends, a minus signal is sent out of IC3 to IC5 to turn off the electromagnetic valve Re. Then the water is to be stopped. The time switch S can be freely used to supply water to the shower head for an adjustable preset period of time, saving manual operation of supplying water.

Figure 20:
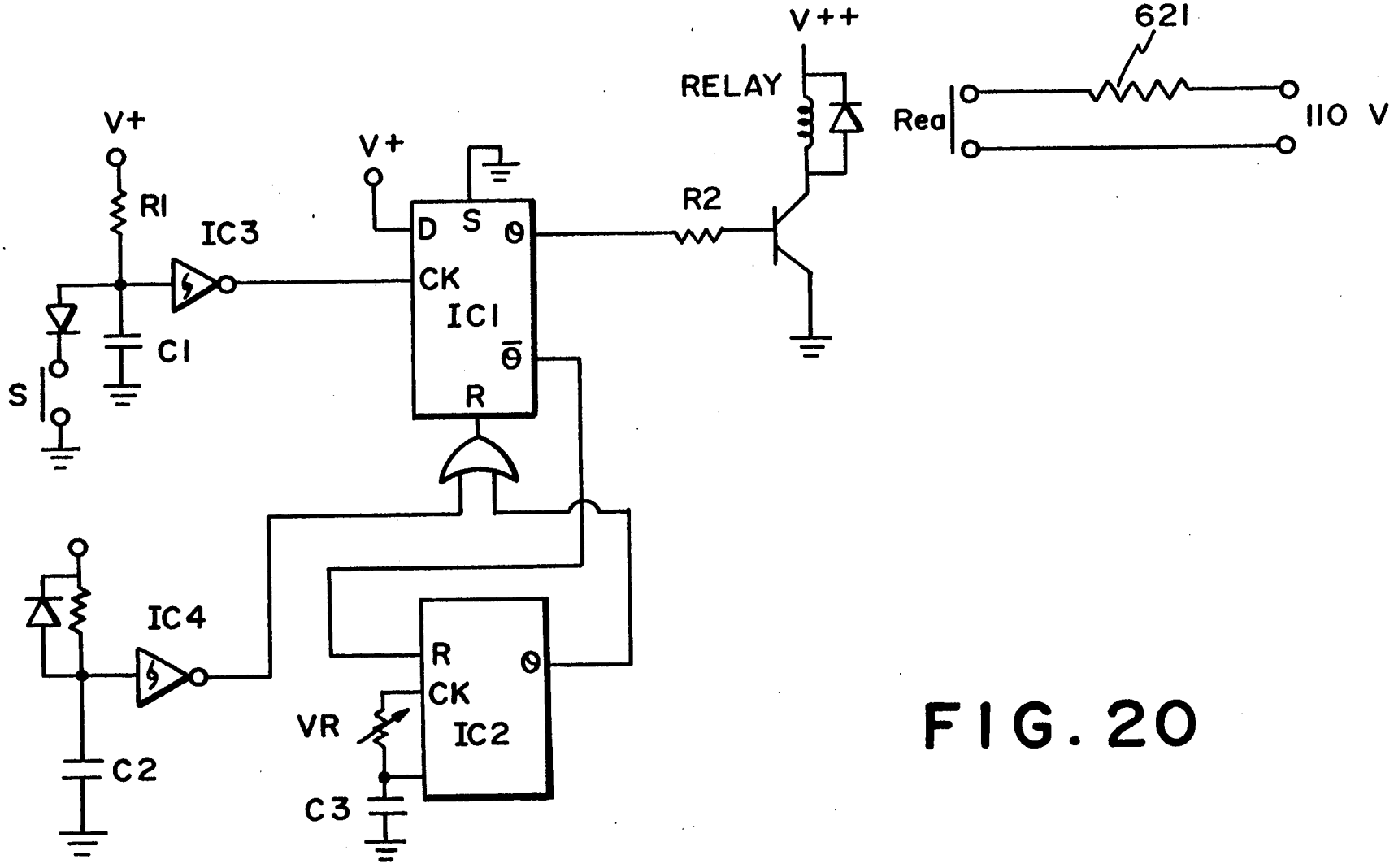
FIG. 20 is the diagram of the electric circuit for controlling the heater in the present invention.

A time switch 672 is also provided at a lower side wall of the electric heat case 6 near the switch 671, for controlling the operation time of a heater tube 621 in the heating chamber 62. Thus, the water in said chamber 62 can be heated up for a preset period of time so as to be vaporized. The switch 672 is represented as S in the diagram of an electric circuit shown in FIG. 20. When the switch S is turned on, a plus signal is sent out of IC3 to IC1 to actuate a relay to energize the heater tube 621 and IC2 to start to count the heating time. When the preset time for heatoff the relay to cut off the heater tube 621.

Figure 21:
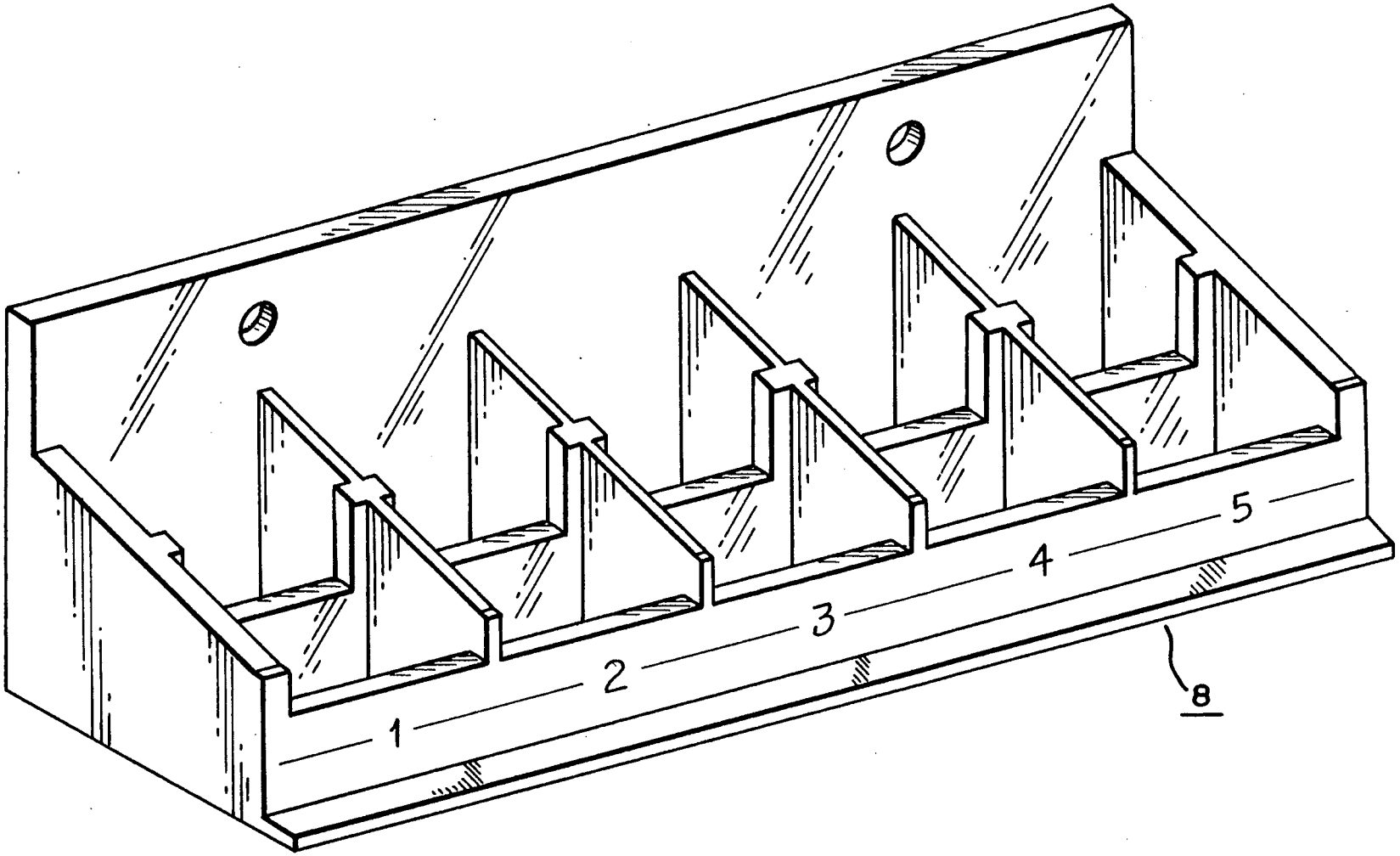
FIG. 21 is a perspective view of the shelf in the present invention.
Figure 22:
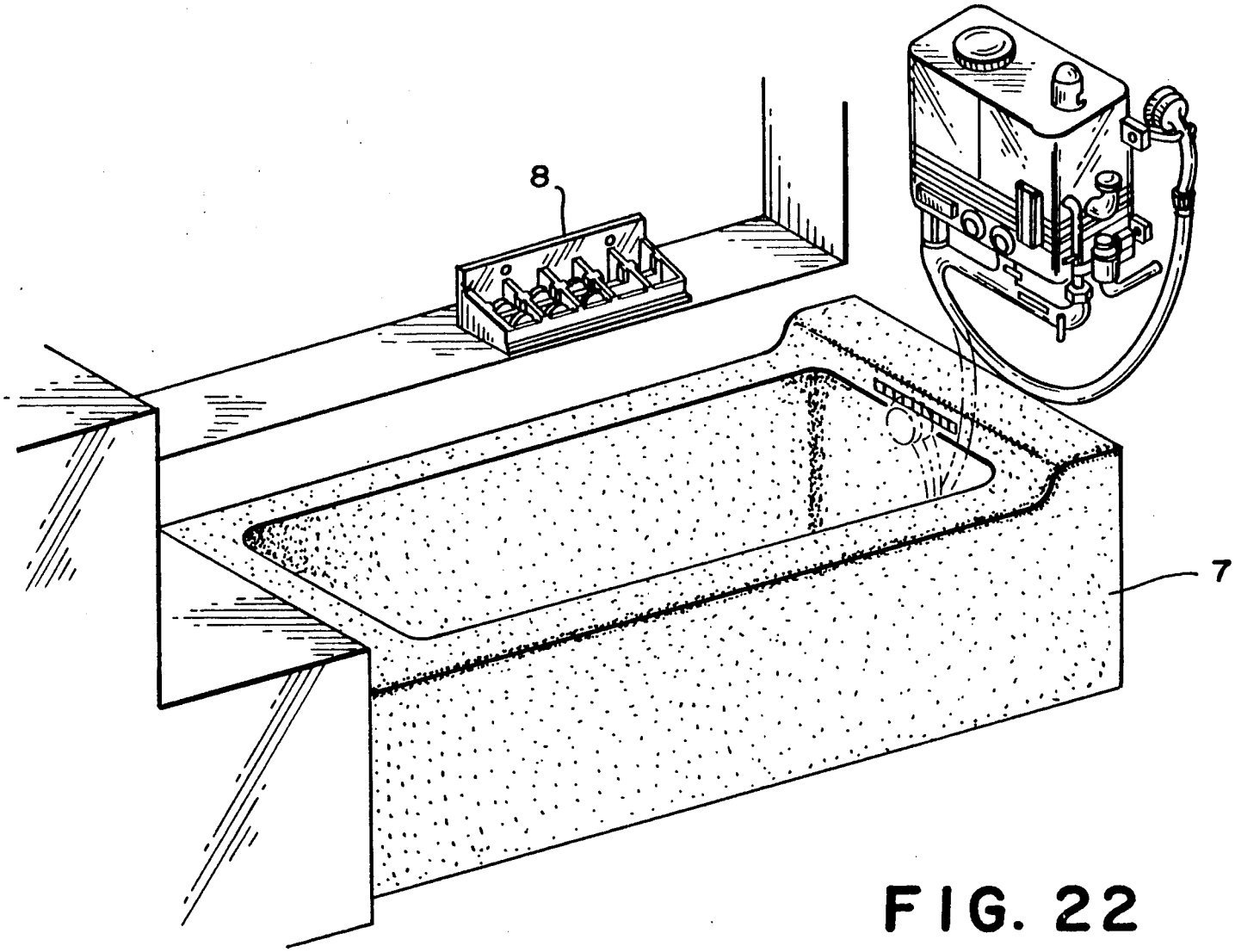
FIG. 22 is a perspective view of the multi-function shower head practically installed in a bathroom.

Lastly, the shower head 1 and the electric heat case 6 are disposed near above a bathtub 7 as shown in FIG. 22. Then, the shower head 1 can be used as a faucet, to save the cost of a faucet. A shelf 8 as shown in FIG. 21 can be installed to put on attachable units such as the bubble unit, the sponge unit, etc. for convenient use.

What is claimed is:

1. A shower head assembly comprising:

a shower head including:

a grip having an inlet end, an outlet end and three tubular passages extending from said inlet end to outlet end, said three tubular passages including a first passage having a space close to the outlet end; a first shaft rotatably mounted in said space, on which an eccentric swinging iron block and a pinion are mounted, a second passage connected to a water source for supplying water and a third passage connected to a soap solution source for supplying a soap solution;

a shower head body secured to the outlet end of the grip and including:

a first cylindrical gate disc having an inlet side abutting the outlet end of the grip and an outlet side defining a surface formed with three concentric circular grooves and a semi-cylindrical groove extending radially in the surface thereof and three round holes located in the circular grooves along the semi-cylindrical groove to intercommunicate the inlet side and the outlet side;

a second cylindrical gate disc having an inlet side defining a surface adapted to be attached to the surface of the outlet side of the first cylindrical gate disc and formed with a semi-cylindrical groove in the surface thereof to match the semi-cylindrical groove of the first cylindrical gate disc to form an radial long groove when the second cylindrical gate disc is attached to the first cylindrical gate disc, an outlet side opposite to the inlet side thereof and three concentric circular passages corresponding to the concentric circular grooves of the first cylindrical gate disc and intercommunicating the inlet and outlet sides of the second cylindrical gate disc;

a cylindrical gate rotatably fitted in the radial long groove between the first and second cylindrical gate disc and formed with three inlet holes in a staggered arrangement to sequentially correspond to one of the three round holes in the circular grooves of the first cylindrical gate disc by rotating the cylindrical gate;

an outlet disc attached to the outlet side of the second cylindrical gate disc and formed with a plurality of perforations along three concentric circles corresponding to the three concentric circular passages and extending axially therethrough communicating with the outlet side of the second cylindrical gate disc;

a central passage extending axially through the central portions of the first cylindrical gate disc and the second cylindrical gate disc and the outlet disc; and a cylindrical shaft rotatably fitted in the central passage and having a first end formed with a square recess adapted to receive an attachment and a second end sleeved with a gear rotatably engaging the pinion of the first shaft in the first passage of the grip;

a driving unit including a motor with an output shaft and a flexible wire rope with a first end connected to the output shaft of the motor and a second end connected to the first shaft in the first passage of the grip so as to drive the first shaft and the cylindrical shaft to rotate said attachment.

2. A shower head assembly as claimed in claim 1, wherein said attachment comprises a bubble unit, said bubble unit includes a frame body adapted to be attached to the shower head body and to rotatably support a fan, a cover net attached to one side of the frame body and extending across a discharge end of the fan and a shaft of a square cross-section extending axially from the fan and adapted to be fitted in the square recess of cylindrical shaft so as to give rise to bubbles when the unit is dipped and driven to rotate in a bubble solution.

3. A shower head assembly as claimed in claim 1, wherein said attachment comprises a sponge unit, said sponge unit includes a frame body adapted to be attached to the shower head body and to rotatably support a rubber block and a shaft of a square cross-section extending axially from the rubber block and adapted to be fitted in the square recess of the cylindrical shaft so as to be driven to rotate to wash and clean a human body with soap solution and water supplied through the second and third passages in the grip.

4. A shower head assembly as claimed in claim 1, wherein said attachment comprises a massage unit, said massage unit includes a frame body adapted to be attached to the shower head body and to rotatably support a massage semi-circular member and a shaft of a square cross-section extending axially from the massage semi-circular member and adapted to be fitted in the square recess of the cylindrical shaft so as to perform a massage function by a rotation movement of the massage semi-circular member and a vibrating movement conducted by an unbalanced motion of the swinging iron block.

5. A shower head assembly as claimed in claim 1, wherein an electric heat case is provided, said electric heat case is divided into a first chamber for loading a soap solution to serve as the soap solution source for the grip of the shower head, a second chamber for accommodating the motor of the driving unit, a third chamber having an electric heater for generating water therein into vapor.

6. A shower head assembly as claimed in claim 5, wherein the electric heat case of the shower head assembly further comprises a conduit connected to the third chamber to discharge vapor therefrom and a water inlet pipe connected to the water source and having a first branch connected to the third chamber for feeding water therein and a second branch leading water from the water source to by-pass the electric heat case.

7. A shower head assembly as claimed in claim 5 or 6, wherein a hose is provided to interconnect the shower head and the electric heat case, said hose is divided into three passages extending through the length thereof, a first passage for accommodating the flexible wire rope, a second passage with a first end connecting an outlet end of the pipe of the electric heat case for discharging vapor and the second branch of the water inlet pipe and a second end connecting the second passage of the grip to lead the vapor from the conduit and water from the water source into the second passage of the grip, and a third passage intercommunicating the first chamber of the electric heat case and the third passage of the grip to lead a soap solution from the electric heat case into the shower head.

* * * * *